US012140002B2

(12) United States Patent
Hestetun

(10) Patent No.: US 12,140,002 B2
(45) Date of Patent: Nov. 12, 2024

(54) COMPACT DUAL HEADER MANIFOLD LAYOUT

(71) Applicant: Vetco Gray Scandinavia AS, Stavanger (NO)

(72) Inventor: Steinar Lindemann Hestetun, Billingstad (NO)

(73) Assignee: Vetco Gray Scandinavia AS, Stavanger (NO)

( * ) Notice: Subject to any disclaimer, the term of this patent is extended or adjusted under 35 U.S.C. 154(b) by 0 days.

(21) Appl. No.: 18/256,839

(22) PCT Filed: Dec. 14, 2021

(86) PCT No.: PCT/EP2021/025499
§ 371 (c)(1),
(2) Date: Jun. 9, 2023

(87) PCT Pub. No.: WO2022/128157
PCT Pub. Date: Jun. 23, 2022

(65) Prior Publication Data

US 2024/0026757 A1 Jan. 25, 2024

(30) Foreign Application Priority Data

Dec. 15, 2020 (NO) ..... 20201376

(51) Int. Cl.
*E21B 43/017* (2006.01)
*B22F 3/15* (2006.01)
*E21B 43/013* (2006.01)

(52) U.S. Cl.
CPC ..... *E21B 43/0175* (2020.05); *B22F 3/15* (2013.01); *E21B 43/013* (2013.01)

(58) Field of Classification Search
CPC ..... E21B 43/0175; E21B 43/013; B22F 3/15
See application file for complete search history.

(56) References Cited

U.S. PATENT DOCUMENTS 5,280,766 A * 1/1994 Mohn ..... F04D 29/606 166/368
6,378,613 B1 * 4/2002 Kent ..... E21B 34/04 166/88.4

(Continued)

FOREIGN PATENT DOCUMENTS

AU 2020347749 B2 * 8/2023 ..... E21B 33/035
CN 202100243 U 1/2012

(Continued)

OTHER PUBLICATIONS

"Hip Manufacture Extending From Subsea to Downhole Applications", Offshore, Pennwell, Tulsa, OK, US, vol. 62, No. 3, Mar. 1, 2002 (Mar. 3, 2002), p. 98, XP001116578, ISSN: 0030-0608 the whole document.

*Primary Examiner* — Aaron L Lembo
(74) *Attorney, Agent, or Firm* — Baker Hughes Patent Organization

(57) ABSTRACT

A dual header oil and gas industry hydrocarbon production manifold. A plurality of three-way directional valves separate fluid flow between a well side of manifold and a pipeline side of the manifold. Two headers include header bodies and header flow paths and a pipeline side couplings. Each of two elbow pipes, provide a flow path between one of the headers, and a port on one of the plurality of three-way valves. At least one T-pipe, provides a flow path between one of the headers, and a port on two of the plurality of three-way valves. A manifold body or any of its main parts may be hipped. A layout with such a manifold is also disclosed.

10 Claims, 4 Drawing Sheets

(56) References Cited

U.S. PATENT DOCUMENTS

| | | | | |
|---|---|---|---|---|
| 6,968,902 | B2 * | 11/2005 | Fenton | E21B 43/40 175/7 |
| 7,093,661 | B2 * | 8/2006 | Olsen | E21B 43/13 166/266 |
| 7,219,740 | B2 * | 5/2007 | Saucier | E21B 34/04 166/344 |
| 7,520,989 | B2 * | 4/2009 | Ostergaard | E21B 43/36 166/267 |
| 8,613,323 | B2 * | 12/2013 | Garbett | E21B 33/0353 166/344 |
| 9,169,709 | B2 * | 10/2015 | Vincent | E21B 43/01 |
| 9,702,215 | B1 * | 7/2017 | Murphy | E21B 34/04 |
| 9,765,593 | B2 * | 9/2017 | Ross | E21B 33/043 |
| 10,400,528 | B2 * | 9/2019 | Kalia | E21B 43/12 |
| 10,533,399 | B2 * | 1/2020 | Ceccon De Azevedo | E21B 43/0107 |
| 10,619,471 | B2 * | 4/2020 | Kajaria | E21B 43/2607 |
| 10,816,137 | B2 * | 10/2020 | Herman | F16N 21/00 |
| 10,947,822 | B2 * | 3/2021 | Gomes Martins | E21B 43/0175 |
| 10,982,808 | B2 * | 4/2021 | Zerkus | F16N 7/385 |
| 11,015,411 | B2 * | 5/2021 | Tesla | E21B 33/038 |
| 11,053,746 | B2 * | 7/2021 | Rageot | F17D 3/01 |
| 11,230,908 | B2 * | 1/2022 | de Araujo Bernardo | E21B 43/017 |
| 11,230,917 | B2 * | 1/2022 | Al-Salmani | E21B 34/02 |
| 11,391,124 | B2 * | 7/2022 | Donald | E21B 43/017 |
| 11,396,895 | B2 * | 7/2022 | Mollan | E21B 43/017 |
| 11,466,536 | B2 * | 10/2022 | Kajaria | E21B 34/02 |
| 11,542,790 | B2 * | 1/2023 | Hestetun | E21B 43/00 |
| 11,867,024 | B2 * | 1/2024 | Spencer | E21B 41/0007 |
| 2004/0251030 | A1 * | 12/2004 | Appleford | E21B 43/017 166/368 |
| 2009/0183790 | A1 * | 7/2009 | Moore | B22F 5/106 251/118 |
| 2009/0277644 | A1 * | 11/2009 | Mcstay | E21B 33/035 166/336 |
| 2013/0098633 | A1 * | 4/2013 | Fenton | E21B 33/043 166/85.1 |
| 2018/0258742 | A1 | 9/2018 | Sveberg et al. | |

FOREIGN PATENT DOCUMENTS

| | | | | | |
|---|---|---|---|---|---|
| CN | 111173479 | A | | 5/2020 | |
| EP | 3649320 | B1 | * | 4/2021 | E21B 43/017 |
| GB | 2594587 | A | * | 11/2021 | E21B 33/035 |
| WO | WO-9508044 | A1 | * | 3/1995 | E21B 43/017 |
| WO | 02088519 | A1 | | 11/2002 | |
| WO | 2008/070648 | A2 | | 6/2008 | |
| WO | 2019170296 | A1 | | 9/2019 | |
| WO | 2019/240594 | A1 | | 12/2019 | |

* cited by examiner

COMPACT DUAL HEADER MANIFOLD LAYOUT

TECHNICAL FIELD

The present invention relates to a dual header oil and gas industry hydrocarbon production manifold, a hydrocarbon conveying pipeline layout allowing round trip pigging, and use of hot isostatic pressing to manufacture an oil and gas industry hydrocarbon production manifold.

BACKGROUND

The term "manifold" is used in various technical fields, but the present invention defines an oil and gas industry hydrocarbon production manifold to limit the invention to hydrocarbon production manifolds with headers. The headers are connected to branch pipes and pipelines or directly to pipelines with releasable fluid couplings.

Manifolds for hydrocarbon wells are used to join the flow of hydrocarbons from several wells and include a number of inlets and an outlet. The number of inlets for the fluid flow will depend on the number of wells in the vicinity of the manifold. The manifold joins the fluid produced by the wells to one or more flows.

Such manifolds are in some cases also used for injecting fluids into the wells to increase reservoir pressure and to facilitate hydrocarbon production. The injecting fluid flows in the opposite direction of the fluid produced by the well. In this case, both a production manifold and a separate injection manifold are required. Alternatively, may one manifold be used for a combination of production and injection. In this case it is possible to use one header for production and one for injection (Dual header).

Fluid injection typically also include gas injection to provide gas lift to facilitate fluid flow.

Such manifolds are typically located subsea and are thus installed and operated using ROVs. Accordingly, the manifolds include couplings for pipelines etc. that are adapted for ROV use. The valves and auxiliary equipment are then adapted for subsea use.

Manifolds are traditionally bespoke and adapted to specific requirements and includes a number of inlets and/or outlets adapted to the number of wells the manifold is designed to serve. Accordingly, suppliers make each manifold according to customer specifications, which leads to a certain production and assembly period. Each manifold design includes a high number of parts, and the requirement for several designs increases this number, making delivery times long and bespoke manifolds expensive.

Manifolds typically cover a header duct size in the range 8-16" and a service line duct size in the range from 2-6".

The headers typically have an internal diameter corresponding to the inner diameter of the flowline the manifold is designed to be connected to, to allow pigging of the flow line and is typically in the range from 8-16" and the transversal duct may have an internal diameter in the range from 5-8".

Traditional hydrocarbon production manifolds are manufactured as welded designs with a pipe section that requires numerous process steps and internal piping that carry the internal pressure. Welded structures are complicated and welding requires a rigid control and certification regime. Welded designs thus require numerous manufacturing processes. Welded designs rely on a forged hub and an end fitting that requires machining, cladding, and then machining to a final shape before the elements are welded onto the pipe sections. The piping requires induction bending, before being welded to the end fittings.

Hipping or Hot Isostatic P, HIP, is a process allowing parts to be tailor-made without welding and thus not include weaknesses or cracks due to welding. During hot isostatic pressing, fine metal powder is provided in a capsule/casting. The capsule is heated to an elevated temperature and isostatic gas pressure is applied. The resulting part is a solid and dense unit with no inclusions. Not only does this offer more design freedom than traditional assembly, forging or casting, it also reduces the risk of hydrogen induced stress cracking (HISC) due to the very fine microstructure of the finished product. Time-consuming welding and inspections in the forging-machining process is eliminated, lead times and costs can be reduced and up-or down scaling is simple.

SUMMARY

The present invention relates to a compact dual header (two headers) manifold utilizing HIP'ed valve body, pipe and fitting and the three-way directional valve. The solution is cost effective and extremely compact and benefits from the above mentioned advantages of hipping. The dual header manifold is suitable for use in connection with an inline-T field layout. Specifically, the manifold may be formed with a HIP'ed (hot isostatic pressing) valve body, pipes and fittings, and three-way directional valves. The manifold may be located at inline-tee field developments. All parts of the manifold may be formed by HIP'ed material, where any sensor or injection points integrated into the HIP'ed parts. Using HIP'ed technology reduces equipment size and installation requirements.

The present invention focuses on manufacturing a one-piece or very low parts count hydrocarbon production manifold for use in industry related to the production of oil and gas in duplex or super duplex utilizing a HIP (hot isostatic pressing) process or "hipping". Hipping provides a near net shape product with superior and uniform material properties. The body of the hydrocarbon production manifold of the invention may be engineered as one piece using flexible engineering and requires less time from a finished design phase to a finished product. Only minor machining is required to finish the hydrocarbon production manifold.

In in relation to the present invention is super duplex intended to describe stainless steels, typically grade EN 1.4410 developed to meet specific demands of the oil& gas and the chemical industries. They offer the required corrosion resistance and strength. Super duplex stainless steels are difficult to process due to high contents of Cr, Ni, Mo, N and W. A duplex stainless steel may also be used.

The present invention thus results in simplified and flexible engineering, i.e. one finished piece, reduced delivery schedule, and a minimum of assembly.

The simplified hydrocarbon production manifold design reduces costs and makes alterations simple.

The present invention is thus a dual header oil and gas industry hydrocarbon production manifold. The manifold includes a plurality of three-way directional valves with three fluid ports adapted to separate fluid flow between a well side of manifold and a pipeline side of the manifold. A first header includes a first header body and a first header flow path and a first pipeline side coupling. A second header includes a second header body and a second header flow path and a second pipeline side coupling. Each of at least two elbow pipes provides a flow path between one of the first header and the second header, and a port on one of the plurality of three-way valves. At least one T-pipe provides a flow path between one of the first header and the second header, and a port on two of the plurality of three-way valves. A well side coupling is provided on each of the plurality of three-way valves.

The first header body and the second header body are Hot Isostatically Pressed (hipped) elements.

The least two elbow pipes may be integrated in at least one of the first header body and the second header body as Hot Isostatically Pressed (hipped) elements.

The at least one T-pipe may be integrated in at least one of the first header body and the second header body as Hot Isostatically Pressed (hipped) elements.

The at least one T-pipe, the least two elbow pipes and valve bodies of the plurality of three-way directional valves may be integrated in at least one of the first header body and the second header body as Hot Isostatically Pressed (hipped) elements.

The at least one T-pipe, the least two elbow pipes and valve bodies of the plurality of three-way directional valves may be integrated in the first header body and the second header body forming one Hot Isostatically Pressed (hipped) manifold body.

The first and the second header may include a sealed end.

The first and the second header may include a second pipeline side coupling.

The hydrocarbon production manifold may be made of a Super-duplex material.

Furthermore, the invention relates to a hydrocarbon conveying pipeline layout allowing round trip pigging including a first and a second dual header oil and gas industry hydrocarbon production manifold as described above. A first branch pipe is connected to the first dual header manifold and is branched off from a dual ILT, connecting the first dual header manifold to a first pipeline. A second branch pipe is connected to the first dual header manifold and is branched off from the dual ILT, connecting the first dual header manifold to the second pipeline. A first branch pipe is connected to the second dual header manifold branched off from a first ILT, connecting the second dual header manifold to the first pipeline. A second branch pipe of the second dual header manifold is branched off from a second ILT, connecting the second dual header manifold to the second pipeline.

Furthermore, the invention relates to a use of hot isostatic pressing to manufacture an oil and gas industry hydrocarbon production manifold as described above.

DETAILED DESCRIPTION

Figure 1:
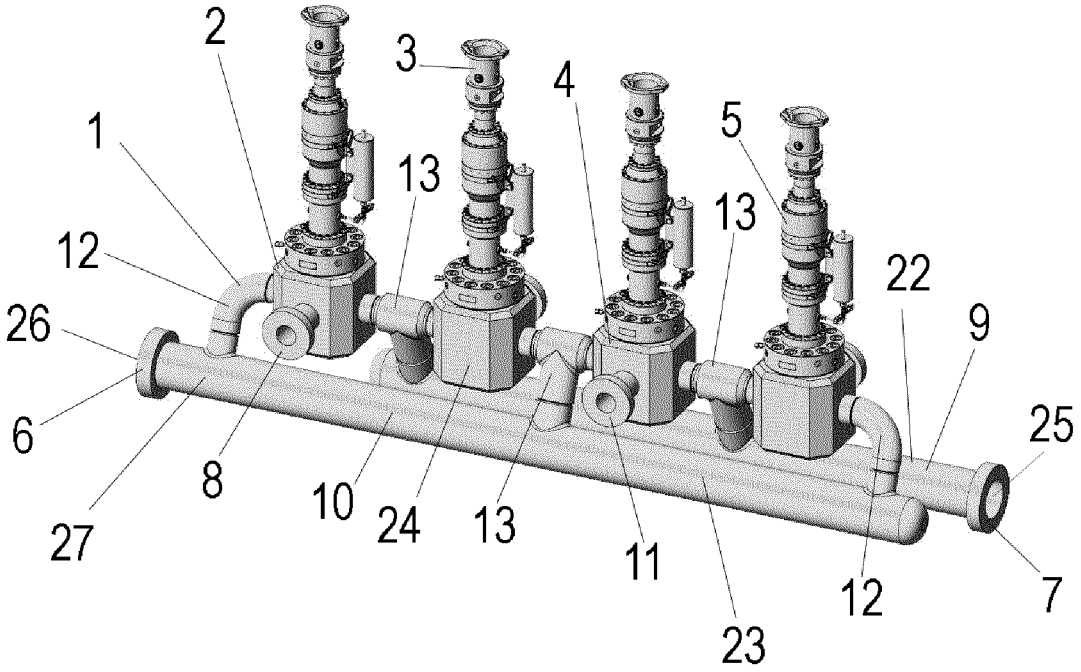
FIG. 1 is a perspective view of a compact manifold of the invention.

Similar reference numerals refer to similar parts throughout this detailed description.

The manifold can be used both in an injection manifold and a production manifold. In a production manifold, will the branch port be an inlet port, and the produced fluid will exit through a header port. In an injection manifold, will however, the branch port be an exit port. The manifold is formed with a HIP'ed (hot isostatic pressing) valve body, pipes and fittings, and two-way directional valves.

The flow described in connection with the manifolds 1, 2 and 3 assumes that wells are producing fluid and that the flow direction is from wells and out of the pipelines.

FIG. 1, shows a compact, hipped hydrocarbon production manifold 1 with two headers with header bodies 22, 23 and header flow paths 25, 26 forming a first header 9, and a second header 10, thus forming a dual header compact production manifold. The first header 9 has a first connecting portion 6 with a male hub for attachment of a metal seal to allow full pressure and structural integrity once connected to a subsea branch pipe to a pipeline or directly to a pipeline. The hub connecting portions may include threads or flanges, typically API flanges. The hubs may include a means for attachment to a clamp connector. All parts of the manifold are formed by HIP'ed material, where any sensor or injection points integrated into the HIP'ed parts.

Couplings 6, 7, 8 may include flanges or hubs typically connected with a clamp connector. Each jumper coupling is typically connected to a x-mas tree through a jumper. Alternatively, could the valves include independent or common, permanently installed powered actuators.

Four three-way valves 2, 4 are in line with each other in a row (a three-way valve is a valve with three ports). Each valve incudes a valve body 24 and a third port forming a jumper port 11 with a well side coupling 8 such as a jumper coupling in the form of a hub or a flange, and a tool bucket 3, to control the flow between a jumper (the well side of the manifold) and the two headers 9, 10 (on the pipeline side of the manifold). The valves form the border between the well side of the manifold and the pipeline side of the manifold. A first port is connected to a flow path to the first header 9 and a second port connected to a flow path to the second header 10. The three ports are located in a T-configuration where two ports have a common central axis. "In-line" in this context indicate that this common central axis is common for all the valves. The four in-line three-way valves 2, 4 are connected with three T-pipes 13, whereof two T-pipes are connected to the first header 9, and one T-pipe is connected to the second header 10. Two elbow pipes 12 connect the valves 4 at the ends of the row with the second header 10. The above configuration with the T-pipes enables each valve 2, 4 to selectively allow flow between a jumper and either of the two headers 9, 10 or to stop the flow completely. The configuration also allow flow through a first valve, through a second valve and then into a header. The headers 9, 10 are parallel to each other, have branch pipe couplings 6, 7 such as hubs or flanges facing in opposite directions and are sealed at one end. The manifold includes a complete manifold body 27.

Figure 2:
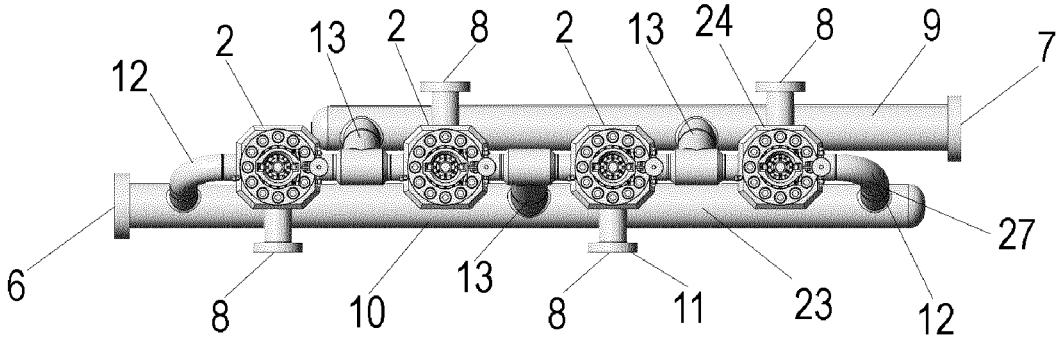
FIG. 2 is a top view of the manifold of FIG. 1.

FIG. 2 shows the manifold 1 of FIG. 1 from above with the four valves 2 including the four valve bodies 24 to clearly show the compact design with the parallel headers 9, 10 in close proximity to each other and the alternating directions of the well side couplings 8. Each inclined T-pipe 13 form a flow path between two valves 2 and a header 9, 10. Each of the two inclined elbow pipes 12 form a flow path between one valve 2 and a header 9, 10.

Figure 3:
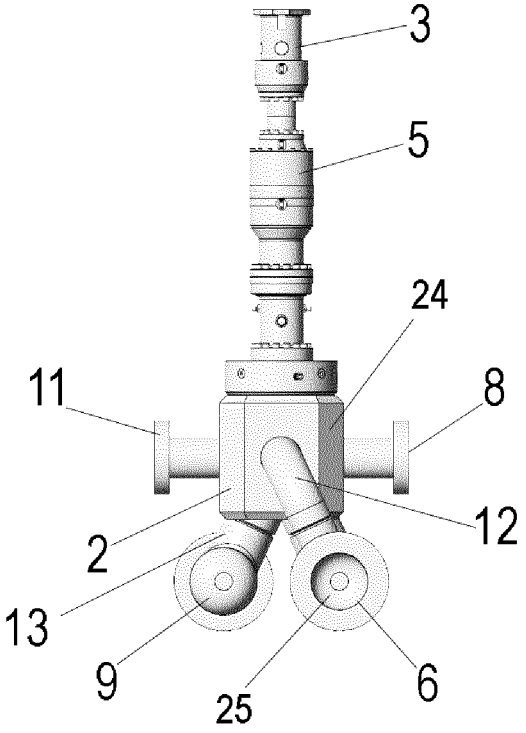
FIG. 3 is a side view of the manifold of FIG. 1.

FIG. 3 shows the manifold 1 of FIG. 1 from the side to clearly show the compact design with the parallel headers in close proximity to each other and an upside-down V-configuration of the T-pipes 13 and the elbow pipes 12. The upside-down V-configuration allows the valves 2 to be located above the headers to thus form a narrow design with the valves on top for easy access from an ROV and easy access to the well side couplings 8.

The tool connector/torque tool bucket 3 on each valve includes a connection for a tool on an ROV to actuate each valve through a valve mechanism 5 independently. The valves are typically gate valves.

The alternate positioning of the well side coupling 8 facing in opposite directions and away from each other provide improved room for the couplings.

The valves 2, 4 are included to enable isolation of each hydrocarbon well connected to the manifold individually.

The headers typically have an internal diameter in the range from 8-16" (203.2 mm-406.4 mm) and the transversal duct/branch holes have an internal diameter in the range from 5-8" (127.0 mm-203.2 mm). The header main duct typically has a diameter corresponding to the inner diameter of a flowline to be connected to the manifold to allow pigging.

Clearly, the manifold may include two, three, five or more valves.

Figure 4:
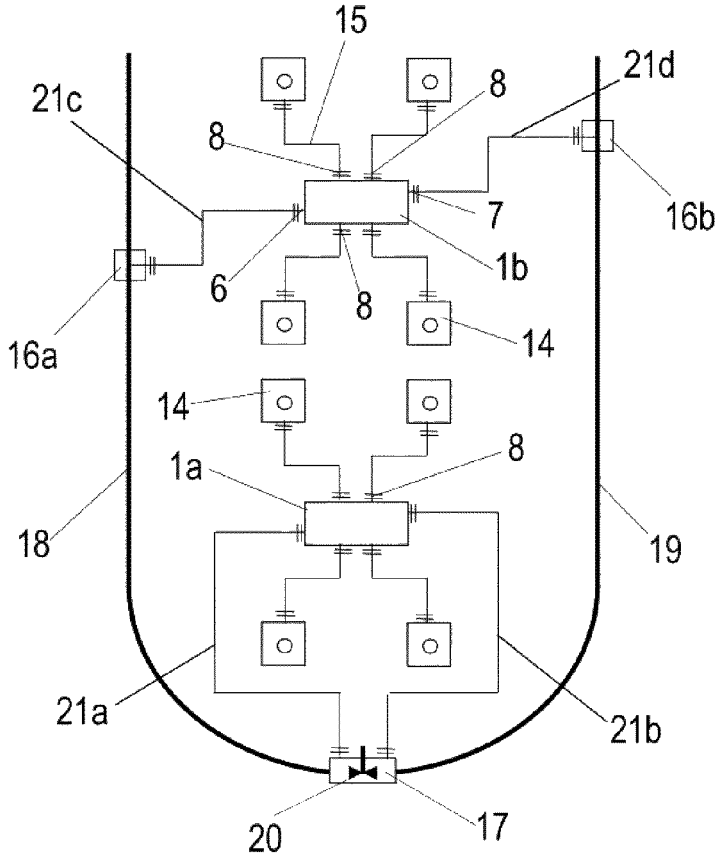
FIG. 4 is a schematic representation of the hipped, hydrocarbon production manifold of the invention installed in an oil and gas industry pipeline configuration.

FIG. 4 is a schematic representation of a pipeline configuration with a manifold of the present invention. A pipeline in this context is primarily an export pipeline, but such a pipeline may also be used for well injection purposes. The term pipeline is however intended to exclude elements such as jumpers between a well and the manifold on a well side of the manifold valves. A first pipeline 18 from a remote location (typically a facility receiving hydrocarbon fluids) is interrupted by a first In-line Tee (ILT) 16*a* and terminates in a connecting arrangement with a cut off valve in a dual In-line Tee (ILT) 17. A second pipeline 19 from the remote location is interrupted by a second In-line Tee (ILT) 16*b* and terminates in the dual In-line Tee (ILT) 17. The dual ILT 17 includes two ports for connection to branch pipes 21*a*, 21*b* from a first dual header manifold 1*a*. The first and second pipeline are permanently welded to the Dual ILT 17.

Each of two manifolds 1*a*, 1*b* of the invention are connected to four wells 14 with jumpers 15. The well side couplings 8 for the jumpers 15 and the branch pipe couplings 6, 7 for the branch pipes 21*a*, 21*b*, 21*c*, 21*d* typically include hubs and clamp connectors. Clearly, the number of wells connected to each manifold 1 can depart from four. The pipeline configuration can be used with only one or more than two manifolds 1*a*, 1*b*.

The jumpers 15 connect each well 14 with a manifold 1*a*, 1*b* through wellheads. Flow paths are provided by branch pipes 21*a*, 21*b*, 21*c*, 21*d* between ILT's 16*a*, 16*b*, 17 and the manifolds 1*a*, 1*b*.

The dual ILT 17 is a full bore ILT allowing a pig to pass from the first pipeline 18 to the second pipeline 19 when the cut-off valve 20 in the dual ILT 17 is open. The first ILT 16 and the second ILT 16 are also full bore ILTs allowing a pig to pass. The ports to the branch pipes and the branch pipes do however not need to be full fore as the pig is not circulated through the branch pipes or the manifolds.

Accordingly, a pig can be circulated through the pipeline 18, past the first ILT 16*a* further through the first pipeline 18, through the dual ILT 17 into the second pipeline 19, through the second ILT 16*b* and further through the second pipeline 19. The first and the second ILTs 16*a*, 16*b* also include cut-off valves to cut the flow of fluids between the pipelines 18, 19 and the branch pipes 21*c*, 21*d* while maintaining the flow through the pipelines 18, 19.

The pig will not be circulated through any of the manifolds 1*a*, 1*b*, and each manifold will only handle fluids from the wells that specific manifold is connected to.

During normal operation (not pigging), the valve connecting the first pipeline 18 and the second pipeline 19 in the dual ILT 17 is closed, isolating first pipeline 18 from the second pipeline 19.

The invention claimed is:

1. A dual header oil and gas industry hydrocarbon production manifold comprising:

a plurality of three-way directional valves with three fluid ports adapted to separate fluid flow between a well side of manifold and a pipeline side of the manifold;

a first header with a first header body and a first header flow path and a first pipeline side coupling;

a second header with a second header body and a second header flow path and a second pipeline side coupling;

at least two elbow pipes, each providing a flow path between one of the first header and the second header, and a port on one of the plurality of three-way valves;

at least one T-pipe, providing a flow path between one of the first header and the second header, and a port on two of the plurality of three-way valves; and, a well side coupling on each of the plurality of three-way valves.

2. The dual header oil and gas industry hydrocarbon production manifold of claim 1, wherein the first header body and the second header body are Hot Isostatically Pressed (hipped) elements.

3. The dual header oil and gas industry hydrocarbon production manifold of claim 2, wherein the least two elbow pipes are integrated in at least one of the first header body and the second header body as Hot Isostatically Pressed (hipped) elements.

4. The dual header oil and gas industry hydrocarbon production manifold of claim 2, wherein the at least one T-pipe is integrated in at least one of the first header body and the second header body as Hot Isostatically Pressed (hipped) elements.

5. The dual header oil and gas industry hydrocarbon production manifold of claim 2, wherein the at least one T-pipe, the least two elbow pipes and valve bodies of the plurality of three-way directional valves are integrated in the first header body and the second header body as one Hot Isostatically Pressed (hipped) manifold body.

6. The dual header oil and gas industry hydrocarbon production manifold of claim 1, wherein the first and the second header includes a sealed end.

7. The dual header oil and gas industry hydrocarbon production manifold of claim 1, wherein the first and the second header includes a second pipeline side coupling.

8. The dual header oil and gas industry hydrocarbon production manifold of claim 1, wherein the hydrocarbon production manifold is made of a Super-duplex material.

9. A hydrocarbon conveying pipeline layout allowing round trip pigging including a first and a second dual header oil and gas industry hydrocarbon manifold of claim 1; wherein a first branch pipe connected to the first dual header manifold is branched off from a dual ILT, connecting the first dual header manifold to a first pipeline; wherein a second branch pipe connected to the first dual header manifold is branched off from the dual ILT, connecting the first dual header manifold to the second pipeline; wherein a first branch pipe connected to the second dual header manifold is branched off from a first ILT, connecting the second dual header manifold to the first pipeline; and wherein a second branch pipe of the second dual header manifold is branched off from a second ILT, connecting the second dual header manifold to the second pipeline.

10. A use of hot isostatic pressing to manufacture an oil and gas industry hydrocarbon production manifold of claim 1.

* * * * *